US006106417A

United States Patent [19]

Umlauft et al.

[11] Patent Number: 6,106,417

[45] Date of Patent: Aug. 22, 2000

[54] LIGHTWEIGHT TENNIS RACKET HAVING HIGH FREQUENCY

[75] Inventors: Helmut Umlauft, Hard; Herfried Lammer, Lochau, both of Austria

[73] Assignee: HEAD Sport Aktiengesellschaft, Kennelbach, Austria

[21] Appl. No.: 09/102,015

[22] Filed: Jun. 22, 1998

Related U.S. Application Data

[63] Continuation-in-part of application No. 08/695,004, Aug. 9, 1996, Pat. No. 5,893,810.

[30] Foreign Application Priority Data

| | | | |
|---|---|---|---|
| Aug. 22, 1995 | [AT] | Austria | 453/95 U |
| Aug. 28, 1997 | [AT] | Austria | 1450/97 |
| Oct. 3, 1997 | [AT] | Austria | 1680/97 |

[51] Int. Cl.[7] ..... A63B 49/08

[52] U.S. Cl. ..... 473/537; 473/524; 473/549

[58] Field of Search ..... 473/537, FOR 173, 473/549, 524, 536, 547

[56] References Cited

U.S. PATENT DOCUMENTS

| | | |
|---|---|---|
| Re. 31,419 | 10/1983 | Frolow . |
| Re. 33,372 | 10/1990 | Frolow . |
| 3,801,099 | 4/1974 | Lair . |
| 4,176,841 | 12/1979 | Sommer . |
| 4,185,822 | 1/1980 | Li . |
| 4,299,348 | 11/1981 | Fukumoto . |
| 4,614,341 | 9/1986 | Fernandez . |
| 5,062,634 | 11/1991 | Strauch et al. . |
| 5,155,896 | 10/1992 | Pai . |
| 5,211,398 | 5/1993 | Awano et al. . |
| 5,368,295 | 11/1994 | Severa et al. . |
| 5,417,418 | 5/1995 | Terzaghi et al. . |
| 5,464,210 | 11/1995 | Davis et al. . |
| 5,551,689 | 9/1996 | Svoma et al. . |
| 5,599,019 | 2/1997 | Davis et al. . |
| 5,605,327 | 2/1997 | McCutchen . |
| 5,613,916 | 3/1997 | Sommer . |
| 5,642,882 | 7/1997 | Guerzini . |
| 5,711,720 | 1/1998 | Janes et al. . |

FOREIGN PATENT DOCUMENTS

| | | |
|---|---|---|
| 0 317 711 | 12/1992 | European Pat. Off. . |
| 0 760 245 A1 | 3/1997 | European Pat. Off. . |
| 0 781 575 A2 | 7/1997 | European Pat. Off. . |
| 27 52 624 A1 | 5/1979 | Germany . |
| 4005973 | 1/1992 | Japan . |
| 05 076 621 | 3/1993 | Japan . |
| 2203953 | 11/1988 | United Kingdom . |

OTHER PUBLICATIONS

Art Citation listing the physical parameters for the commercially produced racquets: Head Big Bang, Prince Extender Mach 1000 PL, Kuebler R50, Wilson Hammer 3.5 Stretch Outer Limits, Wilson Sledge Hammer 2.8, Wilson Sledge Hammer 2.8 Stretch, and Wilson Sledge Hammer 3.8; Sep. 1985–Feb. 1997.

*Primary Examiner*—Sebastiano Passaniti
*Assistant Examiner*—V. K. Mendiratta
*Attorney, Agent, or Firm*—Finnegan, Henderson, Farabow, Garrett & Dunner, L.L.P.

[57] ABSTRACT

A lightweight, high stiffness tennis racket includes a frame having a handle portion with butt end, head portion, and strings supported by the head portion. The racket is formed from a composite material including carbon fibers, titanium fibers, and epoxy resin and includes a length of at least about 27 inches, weight of less than about 9.2 ounces when strung, and a frequency of vibration of the first mode of bending under free-free constraint of at least about 175 Hz. The racket includes a vibration damping unit located about at the racket handle.

36 Claims, 7 Drawing Sheets

| RACKET | L | Wt | F | Ia | Cg | WCg | Cp | Ia/Is | Cp/L | STRING (l) | STRING (w) |
|---|---|---|---|---|---|---|---|---|---|---|---|
| A | 27.7 | 8.70 | 210 | 75.9 | 14.96 | 135.1 | 20.27 | .032 | .732 | 14.3 | 9.92 |
| B | 27.9 | 8.70 | 210 | 75.9 | 15.35 | 136.9 | 20.58 | .032 | .738 | 17.5 | 9.92 |
| C | 27.7 | 8.78 | 176 | 75.9 | 15.16 | 133.1 | 20.19 | .030 | .729 | 13.6 | 9.65 |
| D | 27.7 | 9.2 | 190 | 73.0 | 14.8 | 135.4 | 20.19 | .027 | .728 | 13.6 | 9.4 |

*FIG. 8*

LIGHTWEIGHT TENNIS RACKET HAVING HIGH FREQUENCY

RELATED APPLICATIONS

This is a Continuation-In-Part of U.S. application Ser. No. 08/695,004, entitled "Tennis Rackets", filed Aug. 9, 1996 the subject matter of which is herein incorporated by reference now U.S. Pat. No. 5,893,810 issued on Apr. 13, 1999.

BACKGROUND OF THE INVENTION

1. Field of the Invention

This invention relates to tennis rackets, and more particularly to lightweight tennis rackets having high frequency.

2. Background of the Invention

Tennis rackets today come in many different shapes and sizes. The performance of a tennis racket may be measured by its playing characteristics. Several of the more important playing characteristics include comfort, control, and power. Advances in racket technology over the past two decades have led to rackets in which one of these playing characteristics is improved.

Attempts to design a tennis racket in which comfort, control, and power were all improved, however, have been unsatisfactory. Improvements in one or more playing characteristics have generally had a detrimental effect on other playing characteristics. For example, attempts to increase the control or comfort of a tennis racket have often resulted in a noticeable loss of power. Thus far, no one has successfully designed a tennis racket in which comfort, control, and power have been improved to an acceptable level.

Changes to the physical structure of a tennis racket (e.g., size, shape, balance, weight, material) can affect the playing characteristics of that racket. For example, comfort, control, and power of a larger-sized racket differs from that of a smaller-sized racket. The complex relationships between the myriad of physical parameters that may be measured from a racket and its playing characteristics make it difficult to design a racket having optimal comfort, control, and power. Thus, there is a need for a racket having a physical structure in which a combination of playing characteristics are increased.

SUMMARY OF THE INVENTION

The advantages and purposes of the invention will be set forth in part in the description which follows, and in part will be obvious from the description, or may be learned by practice of the invention. These advantages and purposes will be realized and attained by way of the elements and combinations particularly pointed out in the appended claims.

To attain the advantages and in accordance with the purpose of the invention, as embodied and broadly described herein, the invention is directed to a tennis racket including a handle portion with butt end and a head portion capable of supporting strings, wherein the frame is formed from a composite material including carbon fibers and metallic fibers. The racket further includes a length from the butt end to a top of the head portion of at least about 27 inches, the weight of the racket when strung is less than about 9.2 ounces, and a frequency of vibration of the first mode of bending under free-free constraint of the racket is at least about 175 Hz.

In accordance with another aspect, the present invention comprises a tennis racket including a handle portion with butt end and a head portion capable of supporting strings, wherein the frame is formed from a composite material including titanium fibers. The racket further including a length from the butt end to a top of the head portion of at least about 27 inches, the weight of the racket when strung is less than about 8.8 ounces, and a frequency of vibration of the first mode of bending under free-free constraint of the racket is at least about 175 Hz.

In accordance with yet another aspect, the present invention comprises a tennis racket including a handle portion with butt end and a head portion capable of supporting stings, wherein the frame is formed from a composite material. The racket further including a length from the butt end to a top of the head portion of at least about 27 inches, the weight of the racket when strung is less than about 8.8 ounces, a free-free frequency is greater than 190 Hz, and a center of percussion of greater than 20 inches from the racket butt end.

In accordance with a further aspect, the present invention comprises a tennis racket including a handle portion with butt end, a head portion capable of supporting strings, a throat area between the handle and head portions and a vibration damping unit located at a position about a longitudinal axis of the racket corresponding to an antinode, and the eigenfrequency of the damping unit approximately equals the free-free frequency of the racket. The racket frame is formed from a composite material.

BRIEF DESCRIPTION OF THE DRAWINGS

The accompanying drawings, which are incorporated in and constitute a part of this specification, illustrate several embodiments of the invention and together with the description serve to explain the principles of the invention. In the drawings.

FIG. 8 is a table setting forth the physical parameters of tennis rackets according to the present invention.

DETAILED DESCRIPTION OF THE PREFERRED EMBODIMENT

Reference will now be made in detail to the invention, examples of which are illustrated in the accompanying drawings. The same reference numbers may be used throughout the drawings to refer to the same or like parts.

Consistent with the invention, playing characteristics, such as comfort, control, and power, are optimized in a racket that is ultra-lightweight, has a high frequency, and a high center of percussion. Other parameter values, such as balance, size, and moment of inertia, contribute to the racket's playing characteristics as well.

Figures 1, 1A:
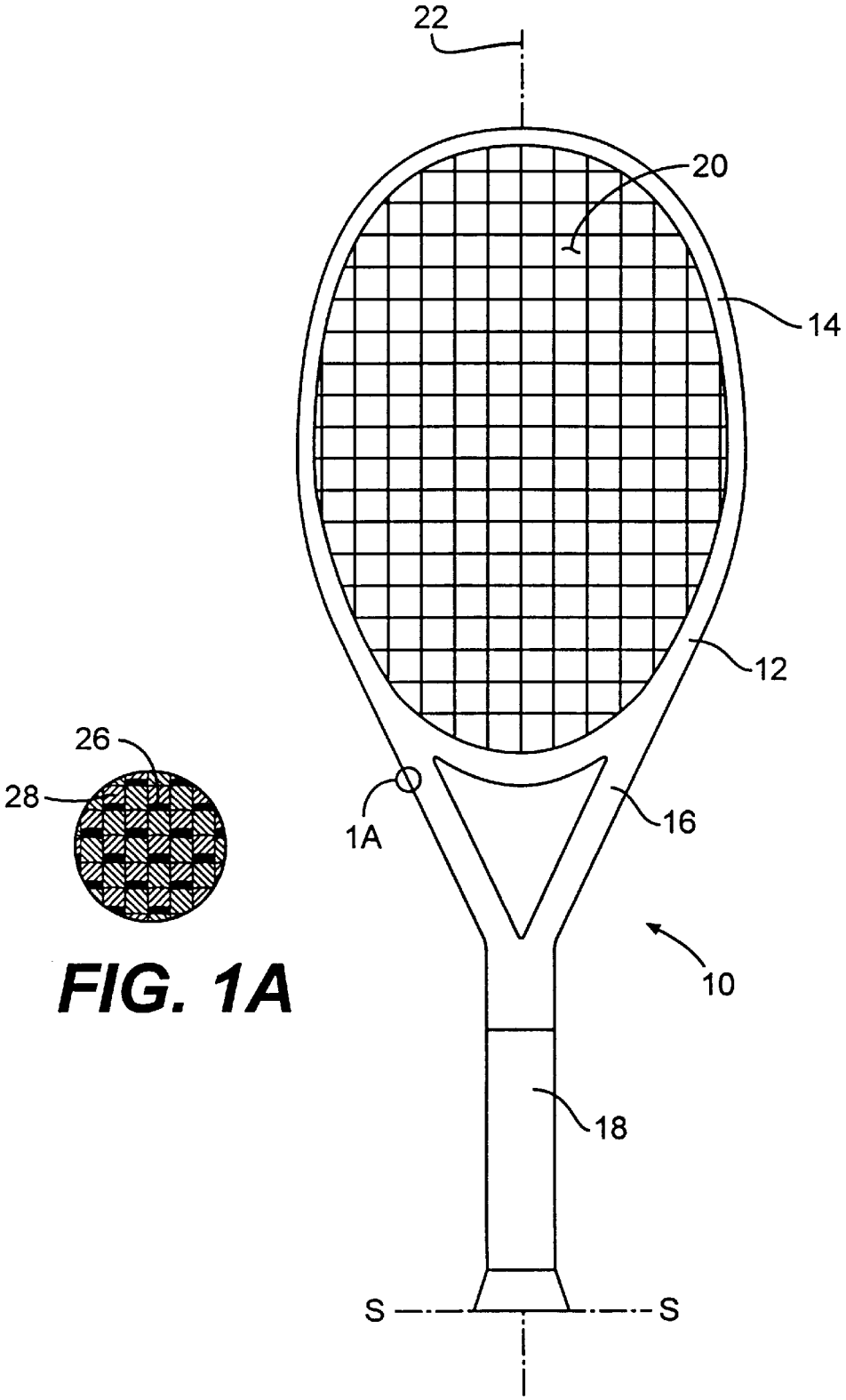
FIG. 1 is a front elevational view of a tennis racket according to a first embodiment of the present invention.
FIG. 1A is an enlarged front elevational view showing the material forming the throat area of the tennis racket of FIG. 1.

According to a first embodiment of the present invention, a tennis racket 10, shown in FIG. 1, includes a frame 12 having a head 14, a throat area 16, and a handle portion 18. Head 14 may be of any shape but is preferably a generally oval shape defining a string area 20 forming the tennis ball hitting surface. Tennis racket 10 further includes a longitudinal axis 22. Consistent with the invention, racket 10 is ultra-light-weight and has a high frequency. Examples of values for physical parameters of tennis racket 10 are listed in rows A–D, respectively, of the table shown in FIG. 8.

The physical parameter values of racket 10 are such that racket 10 achieves optimal playing characteristics, such as comfort, control, and power. While FIG. 8 shows examples, other parameter values may also be used. Preferably, the weight of racket 10 is ultra-light and is less than 9.0 ounces strung. In some implementations of racket 10, the racket weight may be less than 8.0 or 7.0 ounces strung. The frequency of racket 10 is preferably high, and may be more than 180, 190, 200, or even 210 Hertz strung.

Other parameters may also vary. For example, the moment of inertia about the longitudinal racket axis preferably ranges from 70 to 100 ounce inches$^2$, and center of gravity ranges from 14.5 to 16.0 inches from the racket butt end.

Figure 2:
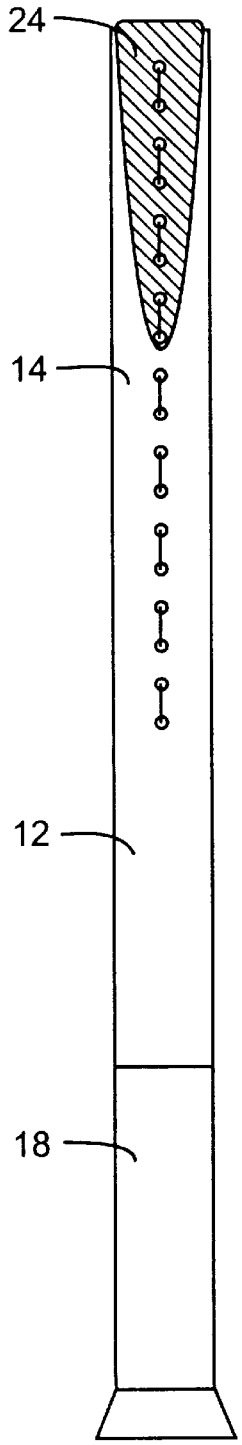
FIG. 2 is a side elevational view of the tennis racket of FIG. 1.

FIG. 2 illustrates a profile of tennis racket 10 shown in FIG. 1. Tennis racket frame 12 includes a substantially constant width from the butt end of handle 18 to the top of head 14. In alternative embodiments, tennis racket frame 12 includes a width that is tapered toward one end or another or both. As shown in FIG. 2, a top portion of racket head 14 may include a sheath 24 for protecting frame 12 from detrimental contact with the ground or other objects.

Tennis racket frame 12 is preferably manufactured of a synthetic composite reinforced with carbon fibers forming a racket prepreg. This prepreg is obtained by layering the carbon composite at several different angles and forming the layers into the desired hollow frame shape. The prepreg is then cured under temperature and pressure to build a frame. Frame 12 is then roughened, finished, and drilled to produce the final product. The combination of the carbon fiber reinforced synthetics and synthetic resin provides a material which may be used to form a racket having beneficial physical properties, such as ultra-lightweight and high frequency, and a strong resistance to dirt and wear.

To further achieve the lightweight, high strength properties, the carbon reinforced synthetic composite is strengthened in the racket throat area 16 with titanium fibers 26. As shown in FIG. 1A, titanium fibers 26 are approximately 0.1 mm in diameter and aligned with the carbon fibers 28 of the synthetic composite during the formation of the racket prepreg.

While reinforcing titanium fibers 26 may be included at any or all locations about tennis racket frame 12, titanium fibers 26 are preferably included in throat area 16 of racket frame 12. Including titanium fibers 26 at throat area 16 helps to relieve high torsional stresses that occur at the junction between the racket head 14 and handle 18 during play. The added strength resulting from the utilization of titanium fibers 26 allows less material to be used, which results in a correspondingly reduced overall weight of racket 10 without a detrimental reduction in strength. Indeed, the use of titanium fibers results in a non-linear improvement in racket strength.

Figure 3:
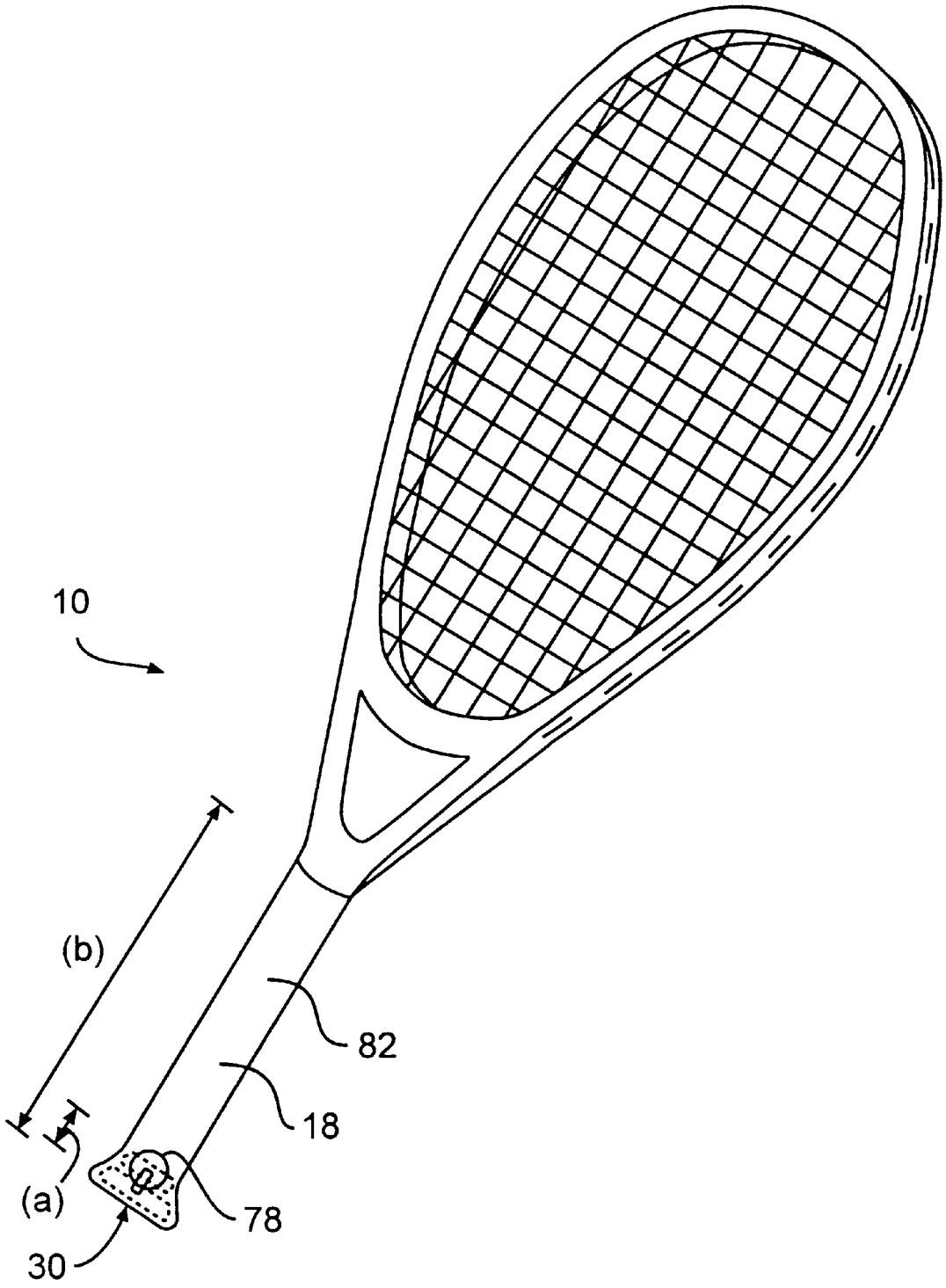
FIG. 3 is a perspective view of the tennis racket of FIG. 1 with a vibration damping unit according to the present invention.

Tennis racket 10 preferably includes a vibration damping unit designated by reference numeral 30 in FIG. 3. Vibration damping unit 30 can be located at any point along racket 10, and is preferably located within handle portion 18 as shown in FIG. 3. Vibration damping unit 30 reduces racket vibration caused during play.

Figure 4:
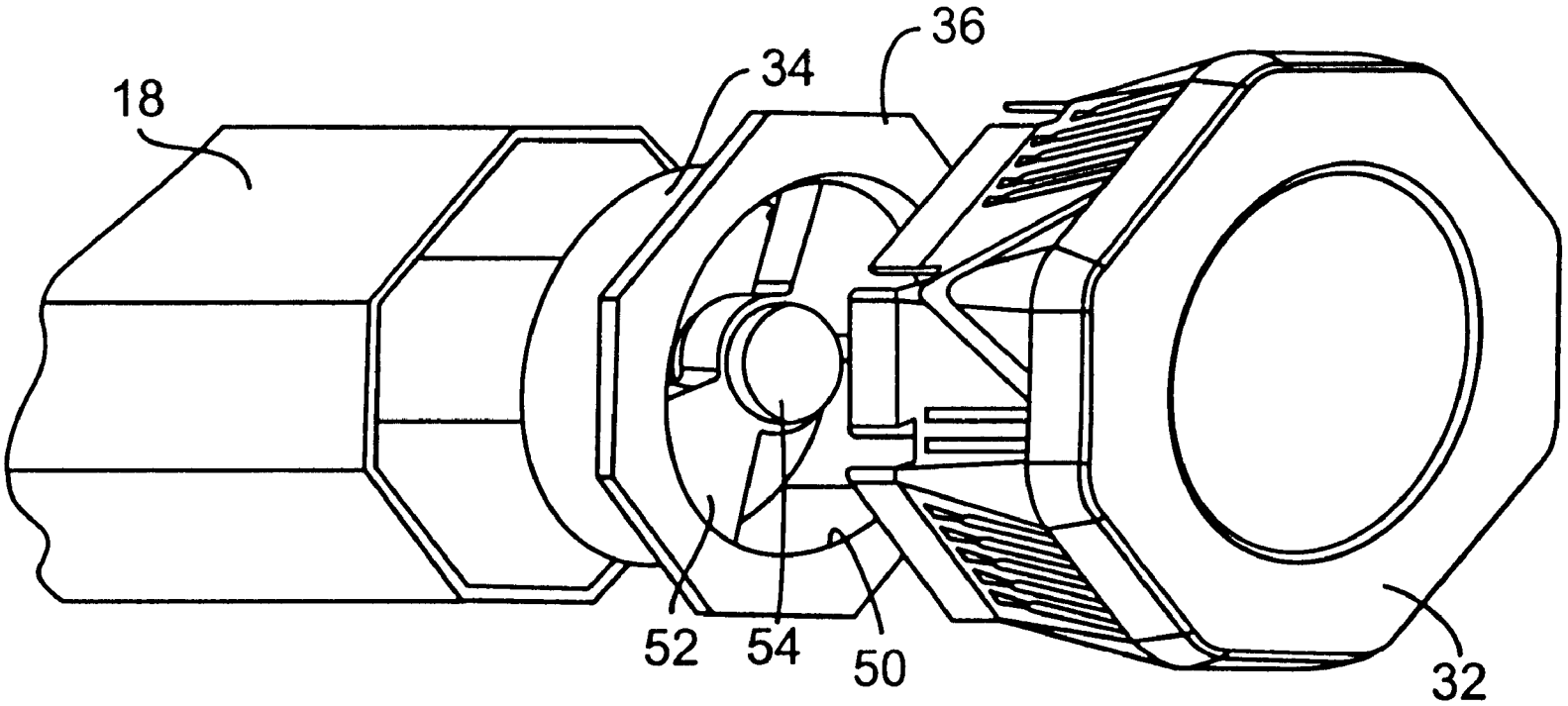
FIG. 4 is a partial exploded view of the handle of the tennis racket of FIG. 1 with the vibration damping unit shown in FIG. 3.
Figure 5:
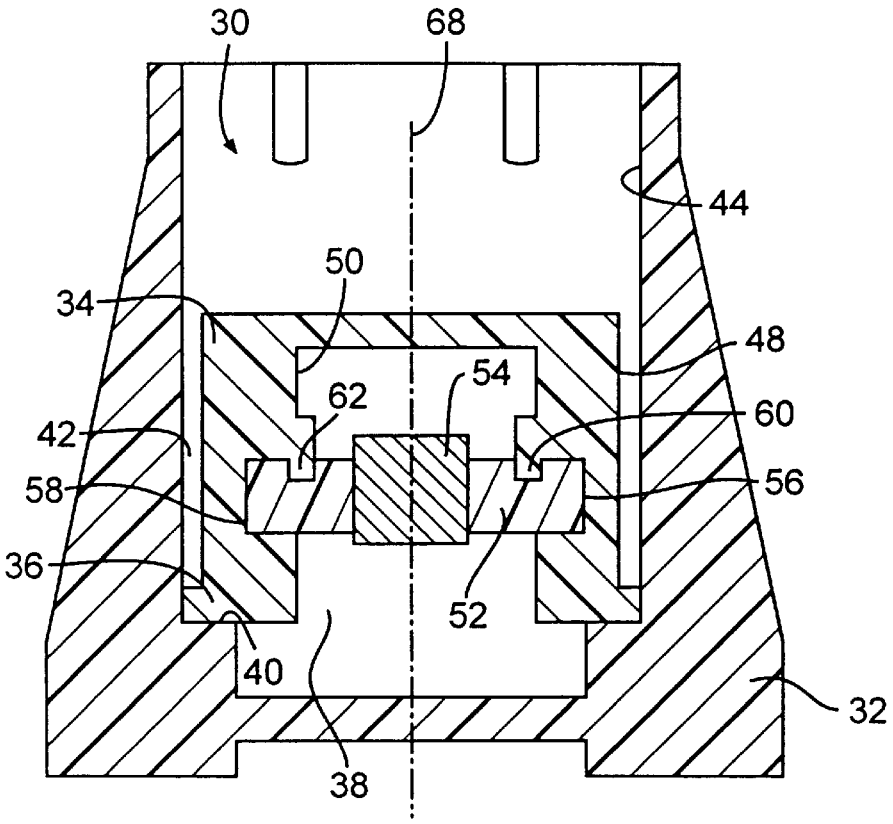
FIG. 5 is a sectional view of the vibration damping unit shown in FIGS. 3 and 4.

With reference to FIGS. 4 and 5, vibration damping unit 30 is received within an end cap 32 of racket 10 and includes a substantially cylindrical mounting cap 34 having a radially extending shoulder 36 adjacent its open end 38 for mating with a bottom interior shoulder 40 of end cap 32. Hollow racket handle 18 is received within a gap 42 between an interior surface 44 of end cap 32 and a cylindrical outer surface 48 of mounting cap 34.

Mounting cap 34 further includes a substantially cylindrical inner surface 50 receiving therein an elastomeric damping weight mount 52 and metallic cylindrical damping weight 54. Damping weight mount 52 may be affixed to the interior of mounting cap 34 by way of epoxy or, as shown in FIG. 4, may be received within opposed recesses 56, 58 formed in the interior of mounting cap 34 and secured in place by mounting cap protrusions 60, 62 extending into damping weight mount recesses 64, 66. When fixed in its final position, vibration damping unit 30 includes a longitudinal axis 68 aligned with longitudinal axis 22 of tennis racket 10.

Figure 6:
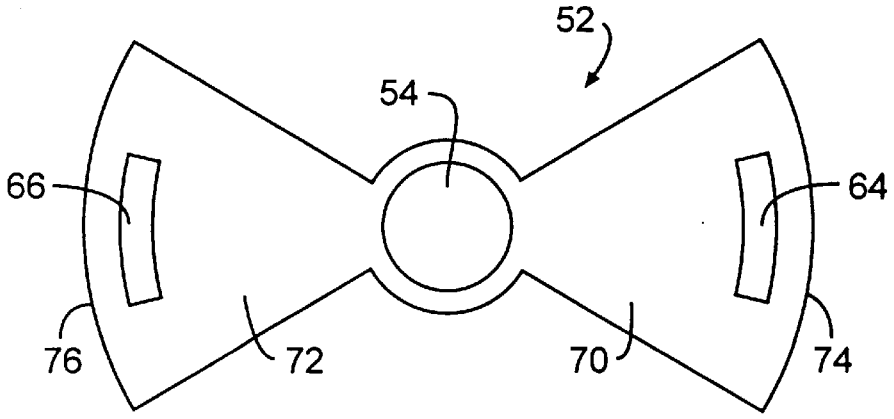
FIG. 6 is a top view of the damping weight mount and damping weight of the vibration damping unit shown in FIGS. 3–5.

Cylindrical damping weight 54 is fixedly secured about its entire radial circumference to a central portion of damping weight mount 52 and includes opposite ends which both extend past the longitudinal extents of damping weight mount 52. FIG. 6 illustrates damping weight mount 52 in a plane perpendicular to damping unit longitudinal axis 68. Damping weight mount 52 is shaped to taper outwardly and away from cylindrical damping weight 54, thus forming damping weight mount wings 70, 72. Damping weight mount wings 70, 72 extend to form semi-circular surfaces 74, 76 farthest from damping weight 54. Semi-circular surfaces 74, 76 mate with corresponding surfaces of mounting cap recesses 56, 58.

According to-the present invention, damping unit 30 emits a vibration to reduce the racket vibrations caused by contact of racket 10 with a ball. This is achieved by preferably locating damping unit 30 at an antinode of the racket corresponding to a location of largest free-free racket vibration amplitude. Damping unit 30 is preferably placed at the antinode 78 (FIG. 3) located about the racket handle end 18 opposite head 14.

The eigenfrequency of the vibration of damping unit 30 is a function of its stiffness and mass. Where $F=(c/m)^{0.5}$ and c=the stiffness of damping unit 30 and m=the mass of damping weight 54. Thus, the size, shape, weight, mounting configuration, and material of damping unit 30 are all selected to produce a damping unit eigenfrequency corresponding to the free-free frequency of racket 10. The stiffness of damping unit 30 is highly influenced by the shape, material, and securing arrangement defined by mount 52.

In one implementation, damping unit 30 includes 1) a damping weight of between 0.6% and 3.5% of the strung racket weight, or between 0.11 and 0.35 ounces, but preferably 0.18 ounces for rackets having weights between 6.35 and 8.8 ounces, 2) a damping unit maximum weight of 30% of the weight of damping weight 54, and preferably 25% the weight of damping weight 54, 3) a mount 52 material of silicone rubber having uniform strength, and 4) a damping unit length (a) of less than 1/10 of the length (b) of handle grip 82 (FIG. 3). Such damping unit parameters in the shapes described above and in FIGS. 4–6 provide for a damping unit 30 of reduced weight, thus minimizing the influence of damping unit weight upon the racket weight, a damping weight 54 that reduces racket vibration by way of its freedom of movement in any direction, and a secure attachment of damping weight 54 to mounting cap 34.

Damping unit 30 further includes a large amplitude of vibration because of the lightweight of racket 10. This large amplitude corresponds to the ratio of the eigenfrequency of the damper weight to that of the eigenfrequency of the racket being less than one, thus providing intensive damping of the racket vibrations.

Damping unit 30 is not restricted to tennis rackets, but may be utilized in any sport racket, including racquetball rackets. The above details concerning damping unit 30 are consistent with its use in other rackets, such as a racquetball racket.

The lightweight comfort of racket 10 described above allows the tennis player to play longer without experiencing fatigue. Further, the improved stiffness of racket 10 provides for a greater transfer of impact energy from racket 10 to the tennis ball, thus reducing energy lost during the collision. Finally the incorporation of vibration damping unit 30 provides for even further comfort by drastically reducing the transmission of racket vibration to the tennis player.

Figure 7:
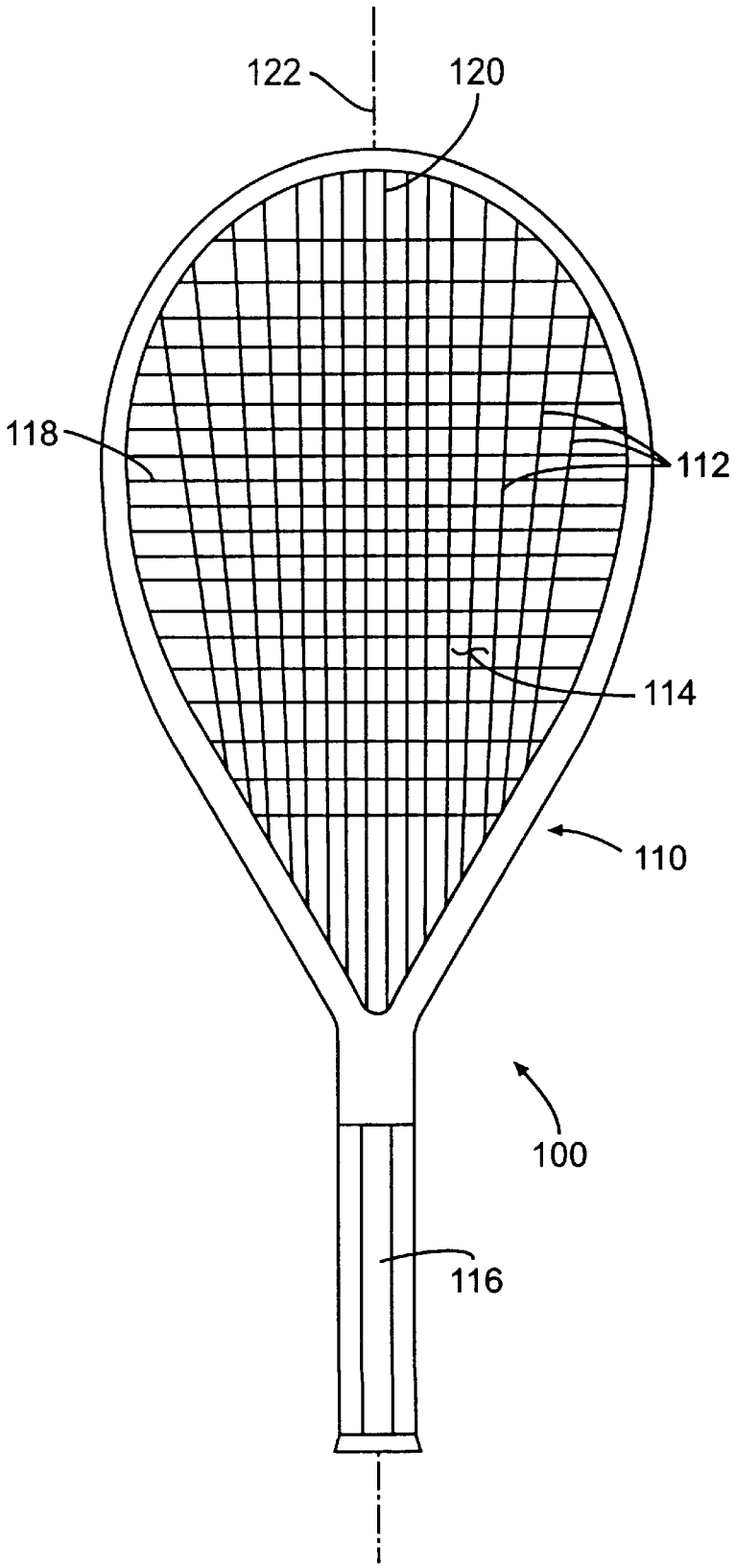
FIG. 7 is a front elevational view of a tennis racket according to a second embodiment of the present invention.

In accordance with second embodiment of the invention, racket 100 is illustrated in FIG. 7. Racket 100 has physical parameter values similar to those of racket 10. Again, examples of parameter values are provided in rows A–D of the table shown in FIG. 8. Racket 100 includes many of the features detailed above with respect to tennis racket 10. Those features of tennis racket 100 that differ from tennis racket 10 are described below.

Tennis racket 100 includes a head configuration 110 providing for an enlarged sweet spot. This is achieved by constructing racket head 110 without a conventional throat bridge member and with a unique stringing pattern 112. The lack of a throat bridge member allows the string area 114 to have a "tear-drop" shape, therefore expanding the string area to adjacent the handle member 116 and enlarging the sweet spot. Enhancement of the sweet spot may be achieved by providing a longest string 118 in the width direction of the string face to be less than 0.6 the length of the longest string 120 in the longitudinal direction of the string face, or with the longest sting 116 in the longitudinal direction being greater than 0.6 the length of racket 100, but preferably 0.65 the length of racket 100.

Racket head 110 includes stringing pattern 112 having longitudinally directed strings diverging away from a longitudinal axis 122 of the racket. The divergence of the strings increases with those strings farther away from longitudinal axis 122 of the racket. Stringing pattern 112 not only reduces racket weight by requiring less string, but increases the sweet spot in the racket width direction because of the diverging strings.

The removal of the throat bridge member in racket 100 further improves control of racket 100 by providing a large difference between the vibrational frequencies along and normal to the racket string area 114. This deviation can be at least 20%, but is preferably 25%.

Tennis racket 100 also includes vibration dampening system 30 detailed above. Vibration damping system 30 has similar effects to the natural frequency of racket 100 as to racket 10. Racket 100 is also constructed of a material similar to the one described in connection with racket 10.

Turning to the table of FIG. 8, rows A–D list various physical parameters of rackets in accordance with the invention.

The listed parameters are as follows:

| | |
|---|---|
| L = | the length of the racket in inches along its longitudinal axis; |
| Wt. = | the weight of the racket in ounces; |
| F = | the free-free frequency of the racket in Hertz, obtained by supporting the racket on one nodal point and using an oscillating external force on the other nodal point to vibrate the racket. Wherein, the frequency of the external force is equal to the frequency of the racket when such a force creates a characteristic standing wave on the racket; |
| la = | the moment of inertia of the racket about its longitudinal axis in ounce-inches squared, obtained by what is known as the trifilar method. According to this method, the racket is oscillated about its longitudinal axis while three fibers, each of which has a length of approximately 1.5 meters, are connected to the racket from a fixed point above the racket. Then the oscillation time of the racket is measured and utilized in the following equation: $la = ((Wt.)(9.807)(r1)(r2)(t^2))/((4)(l)(TT^2))$ where (r1) and (r2) are the radii of the circles formed by the three aforementioned fibers; (i) was the length of the fibers, and (t) was the time to complete one oscillation; |
| WCg = | the product of the racket's weight and center of gravity (measured in inches from the butt end of the racket) in ounce inches; |
| Cp = | the center of percussion of the racket in inches measured from the butt end of the racket, obtained by the following equation: $Cp = (9.79)(t^2)$ according to this formula, (t) is the time to complete one pendulum swing about an axis located at the racket butt end; |
| la/ls = | the ratio of the racket's moment of inertia about its longitudinal axis to its moment of inertia about the butt end of the racket. ls is obtained according to the following equation: $ls = ((Wt.)(Cg)(t^2))/(4024.3)$ according to this equation, (Cg) is obtained by measuring the distance from the butt end of the racket to the balance point of the racket and (t) is the time to complete one pendulum swing about an axis located at the racket butt end; |
| Cp/L = | the ratio of the racket's center of percussion to length; |
| (l) = | the length in inches of the longest string in the racket's longitudinal direction; and |
| (w) = | the length in inches of the longest string in a direction normal to the racket's longitudinal axis. |

String weight contributes approximately 0.5 ounces to the weight of a strung racket. Thus, the unstrung weight may be calculated by appropriately subtracting string weight from the given strung racket weight.

It will be apparent to those skilled in the art that various modifications and variations can be made in the disclosed method and apparatus without departing from the scope or spirit of the invention. Other embodiments of the invention will be apparent to those skilled in the art from consideration of the specification and practice of the invention disclosed herein. It is intended that the specification and examples be considered as exemplary only, with the full scope of the invention being defined by the following claims.

What is claimed is:

1. A tennis racket comprising:

a handle portion with butt end; and a head portion capable of supporting strings;

wherein the racket is formed from a composite material including carbon and metallic; and wherein the length of the racket from the butt end to a top of the head portion is at least about 27 inches, the weight of the racket is less than about 9.2 ounces when strung, and a frequency of vibration of a first mode of bending under free-free constraint of the racket is at least about 175 Hz.

2. The tennis racket of claim 1, wherein the metal is titanium.

3. The tennis racket of claim 2, further comprising a throat area located between the handle portion and the head portion, and wherein titanium is only located in the throat area.

4. The tennis racket of claim 3, wherein:

the titanium includes titanium fibers.

5. The tennis racket of claim 1, further comprising:

a vibration damping unit located at a position about a longitudinal axis of the racket corresponding to an antinode, an eigenfrequency of the damping unit being approximately equal to a free-free frequency of the racket.

6. The tennis racket of claim 5, wherein:

the damping unit includes a damping weight elastically suspended from a mounting cap located within an end cap of the racket, the suspension allowing the damping weight freedom of movement in all directions in response to vibration of the racket.

7. The tennis racket of claim 6, further including:

an elastomeric damping weight mount fixedly secured at an inner portion to a periphery of the damping weight and at an outer portion to the mounting cap.

8. The tennis racket of claim 7, wherein:

the damping weight is metallic, extends longitudinally beyond the damping weight mount at each damping weight longitudinal end, and weighs between about 0.11 and 0.35 ounces; and the damping weight mount tapers to a larger size from the inner portion to the outer portion.

9. The tennis racket of claim 8, wherein:

a maximum weight of the damping unit does not exceed 30% of the weight of the strung racket and the length of the damping unit is less than one tenth the length of a handle grip of the racket.

10. The tennis racket of claim 1, further comprising:

a center of gravity of at least about 14.9 inches from the racket butt end when the racket is strung and a center of percussion of at least about 20 inches from the racket butt end.

11. The tennis racket of claim 10, further comprising:

a moment of inertia about a longitudinal axis of the racket of at least 73 ounce-inches squared.

12. The tennis racket of claim 1, wherein:

the weight of the racket is less than 8.8 ounces when strung, the racket free-free frequency is at least 190 Hz, and a center of percussion of the racket is at least 20.2 inches.

13. The tennis racket of claim 12, wherein the head portion defines a string hitting area of at least about 115 square inches.

14.The tennis racket of claim 13, wherein the head portion has a generally ovoid shape.

15. The tennis racket of claim 12, wherein the head portion defines a string hitting area of at least about 124 square inches.

16. The tennis racket of claim 15, wherein the head portion has a generally teardrop shape and is devoid of a throat bridge member.

17. The tennis racket of claim 16, wherein:

a longest string length defined by the head portion in a racket face width direction is less than about 0.6 of a longest string length in a racket face longitudinal direction.

18. The tennis racket of claim 16, wherein:

a longest string length defined by the head portion in a racket face longitudinal direction is greater than 0.6 the length of the racket.

19. A tennis racket comprising:

a handle portion with butt end; and a head portion capable of supporting strings;

wherein the racket is formed from a composite material including titanium; and wherein the length of the racket from the butt end to a top of the head portion is at least about 27 inches, the weight of the racket is less than about 8.8 ounces when strung, and a frequency of vibration of a first mode of bending under free-free constraint of the racket is at least about 175 Hz.

20. A tennis racket comprising:

a handle portion with butt end; and a head portion capable of supporting stings;

wherein the racket is formed from a composite material; and wherein the length of the racket from the butt end to a top of the head portion is at least about 27 inches, the weight of the racket is less than about 8.8 ounces when strung, a free-free frequency of the racket is greater than 190 Hz, and a center of percussion of the racket is greater than 20 inches from the racket butt end.

21. The tennis racket of claim 20, wherein the free-free frequency of the racket is greater than 200 Hz.

22. The tennis racket of claim 20, wherein the head portion defines a string hitting area of at least about 115 square inches.

23. The tennis racket of claim 22, wherein the head portion has a generally ovoid shape.

24. The tennis racket of claim 20, wherein the head portion defines a string hitting area of at least about 124 square inches.

25. The tennis racket of claim 24, wherein the head portion has a generally teardrop shape and is devoid of a throat bridge member.

26. The tennis racket of claim 25, wherein:

a longest string length defined by the head portion in a racket face width direction is less than about 0.6 of a longest string length in a racket face longitudinal direction.

27. The tennis racket of claim 25, wherein:

a longest string length defined by the head portion in a racket face longitudinal direction is greater than 0.6 the length of the racket.

28. The tennis racket of claim 20, wherein the composite material includes titanium.

29. A racket comprising:

a handle portion with butt end;

a head portion capable of supporting strings;

a throat area between the handle and head portions; and a vibration damping unit located at a position about a longitudinal axis of the racket corresponding to an antinode, and an eigenfrequency of the damping unit approximately equals a free-free frequency of the racket;

wherein the vibration damping unit includes a damping weight elastically suspended from a mounting cap located within an end cap of the racket, the suspension allowing the damping weight freedom of movement in all directions in response to vibration of the racket; and wherein the racket is formed from a composite material.

30. The racket of claim 29, wherein the vibration damping unit further includes an elastomeric damping weight mount fixedly secured at an inner portion to a periphery of the damping weight and at an outer portion to the mounting cap.

31. The racket of claim 30, wherein:

the damping weight is metallic, extends longitudinally beyond the damping weight mount at each damping weight longitudinal end, and weighs between about 0.11 and 0.35 ounces; and the damping weight mount tapers to a larger size in a direction from the inner portion to the outer portion.

32. The racket of claim 31, wherein:

a maximum weight of the damping unit does not exceed 30% of the weight of the strung racket and the length of the damping unit is less than one tenth the length of a handle grip of the racket.

33. A vibration damping unit for use in a racket comprising:

a damping weight and a damping weight mount;

wherein the damping weight mount is fixedly secured to a mounting cap located in an end cap of the racket, and the damping weight is elastically suspended from the damping weight mount; and an eigenfrequency of the damping unit approximately equals a free-free frequency of the racket.

34. The vibration damping unit of claim 33, wherein:

the damping unit is located at a position about a longitudinal axis of the racket corresponding to an antinode;

the damping weight mount is elastomeric;

the damping weight is fixedly secured to an inner portion of the damping weight mount.

35. The vibration damping unit of claim 34, wherein:

the damping weight is metallic, extends longitudinally beyond the damping weight mount at each damping weight longitudinal end, and weighs between about 0.11 and 0.35 ounces; and the damping weight mount tapers to a larger size in a direction from the inner portion to the outer portion.

36. The vibration damping unit of claim 35, wherein:

a maximum weight of the damping unit does not exceed 30% of the weight of the strung racket and the length of the damping unit is less than one tenth the length of a handle grip.

* * * * *